United States Patent [19]

Givens

[11] 4,246,951

[45] Jan. 27, 1981

[54] VALANCE AND CORNICE FRAMES

[76] Inventor: Ray K. Givens, 3401 - 92nd, Lubbock, Tex. 79423

[21] Appl. No.: 3,546

[22] Filed: Jan. 15, 1979

[51] Int. Cl.[3] ..... E04F 10/00

[52] U.S. Cl. ..... 160/39

[58] Field of Search ..... 160/19,38, 39, 135; 248/220.2, 225.2

[56] References Cited

U.S. PATENT DOCUMENTS

| | | | |
|---|---|---|---|
| 1,070,842 | 8/1913 | Prescott | 160/39 |
| 1,789,764 | 1/1931 | McAnaney | 160/39 |
| 2,258,044 | 10/1941 | Chesney | 248/225.2 |
| 2,527,216 | 10/1950 | Harris | 248/225.2 |
| 2,636,557 | 4/1953 | Williams | 160/39 |
| 2,998,062 | 8/1961 | Bixby | 160/39 |
| 3,224,489 | 12/1965 | Haberthier | 160/135 |
| 3,372,728 | 3/1968 | Schaefer | 160/39 |

FOREIGN PATENT DOCUMENTS

| | | | |
|---|---|---|---|
| 938713 | 10/1963 | United Kingdom | 160/38 |

*Primary Examiner*—Peter M. Caun
*Attorney, Agent, or Firm*—Wendell Coffee

[57] ABSTRACT

A modular pre-fabricated frame is made for cornices and valances from cardboard or synthetic material. Two portions are telescoped together to form the proper length. Each portion has a tongue which fits over the lip of a rack attached to the wall, thus, supporting the frame for substantially its entire length.

12 Claims, 4 Drawing Figures

14
12
10
16
40
24
22
18
56
54
48
42
38
51
46
28
30
52
32
34
26
124
122
116
118
144
140
152
138
142
126
128
136
132
134
20
44
38
24
16
18
22
56
48
52
54
46
32
34
36
50

VALANCE AND CORNICE FRAMES

CROSS REFERENCE TO RELATED APPLICATIONS

None. However, applicant filed Disclosure Document No. 075052 on Oct. 16, 1978, which document concerns this application; therefore, by separate letter, it is respectfully requested that the document be retained and acknowledgement thereof made by the Examiner. (MoPEP 1706)

BACKGROUND OF THE INVENTION

1. Field of the Invention

This invention relates to window coverings and more particularly to a cornice or valance for covering the top of drapes of a window.

2. Description of the Prior Art

In buildings, drapes are often used for windows. In addition, sometimes drapes are hung over walls for various reasons. In homes, the tops of the drapes often are covered with a valance or a cornice. Usually, the cornice or valance is covered with a fabric to match the drapes. Inasmuch as the inside of the cornice is visible from outside the window, usually, also it is covered with a matching fabric.

With modern house building techniques the floor and ceiling are not always level nor are they always parallel. Therefore, it is necessary that each curtain and cornice be individually hung. Although windows may be standard widths, the decorator may desire the curtains to go a greater width and, therefore, there is no standard sizes for curtains. I.e., they may extend six inches on each side of the window or they may extend only three inches on each side of the window. Because of this flexibility, common commercial practice before this invention was to manufacture the cornice frames or valance frames for each set of curtains individually.

Before this application was filed, the applicant caused a search to be made in the United States Patent and Trademark Office. This search disclosed the following patents:

British Pat. No. 849,517
Donovan U.S. Pat. No. 1,460,575
D'Azzo U.S. Pat. No. 2,487,639
Ziemmerman U.S. Pat. No. 2,539,380
Metz U.S. Pat. No. 2,563,734
Susnow U.S. Pat. No. 2,570,731
Irving U.S. Pat. No. 2,588,243
Woodard U.S. Pat. No. 2,690,796

SUSNOW discloses a cornice having end panels, a front and a top. The top contacts the wall for substantially its full length. The cornice frame is not telescoping and is constructed of wood so that it is supported by two brackets, one adjacent each end.

IRVING discloses a suspension device for drapes. As pertinent here, the description of the SUSNOW device equally fits IRVING.

METZ ET AL. discloses a telescopic rod or bar which extends the full length of the valance, however, the valance is understood by applicant to have no top. The end panels of the valance are the only point by which the valance frame is attached to the telescopic rod.

The other patents do not seem to be as pertinent to my invention as those discussed above.

SUMMARY OF THE INVENTION

(1) New and Different Function

I have invented a frame for cornices and valances which may be pre-fabricated so that it fits a wide variety of window widths. Also, I have invented a frame which is readily made of cardboard or synthetic material, e.g., a material commercially available on the market, well known in the trade, known as ABS Plastic. Although this material does not have the strength of wood, I have invented the method of hanging it whereby a rack or bracket extends continuously along the wall to support the frame along substantially its entire length. With the frame thus supported it does not tend to sag even though it is telescoped and extends over a long span.

The curtain rods themselves may be suspended independently from the wall or may be suspended by rod holders attached to the frame.

The material by which I make my frame is readily pierced by staples from a regular stapler so that the craftsmen may continue to use the same tools and techniques for covering the frame as they have previously.

Normally, the inner or male portion of the telescoping frame would be made longer than the female portion, then if it were desired to shorten the total span, the male portion could be cut, it being on the inside, the cut would not show. Furthermore, I have found it desirable to cover the frame by sponge rubber strips so as to give the fabric which is attached over the covering a pleasing appearance.

Thus, it may be seen that the total function of my combination far exceeds the sum of the functions of the individual racks, panels, tongues, etc.

(2) Objects of the Invention

An object of this invention is to finish the top of drapes.

Further objects are to achieve the above with a device that is sturdy, compact, durable, lightweight, simple, safe, efficient, versatile, ecologically compatible, energy conserving, and reliable, yet inexpensive and easy to manufacture, install, adjust, and maintain.

Other objects are to achieve the above with a method that is versatile, ecologically compatible, energy conserving, rapid, efficient, and inexpensive, and does not require skilled people to install, adjust, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figures 1, 2, 3, 4:
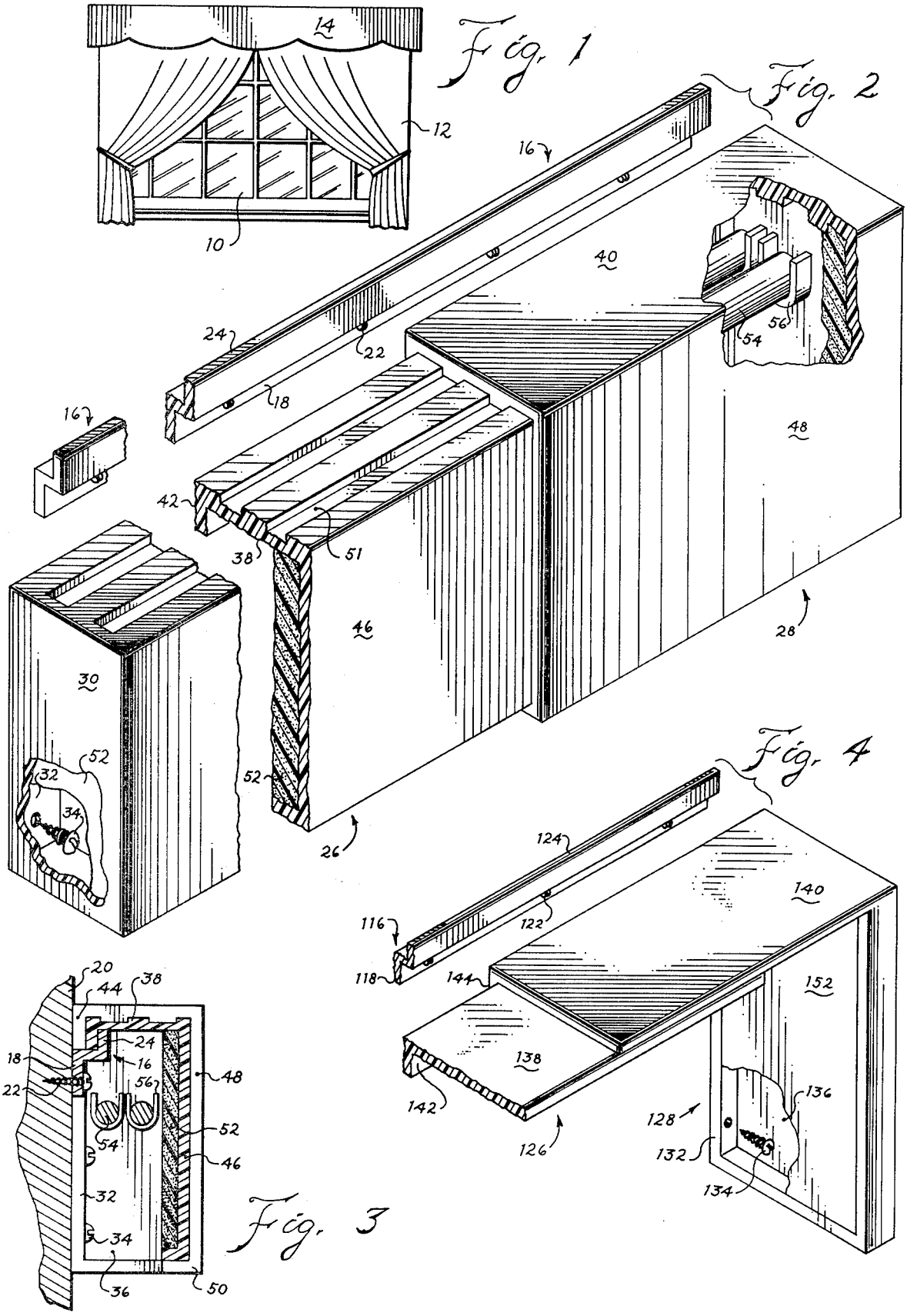
FIG. 1 is a representation of a window with a finished cornice built on a frame according to this invention.
FIG. 2 is a perspective, foreshortened view with parts broken of a frame according to this invention for a cornice.
FIG. 3 is a cross sectional view of the embodiment shown in FIG. 2.
FIG. 4 is a partial perspective view of a frame for a valance according to this invention.

Referring to the FIG. 1 of the drawings, there may be seen a window as finished according to my invention. The window 10 has drapes 12 over it. The top of the drapes are covered or finished by cornice 14. It is the cornice frame which I have invented.

Referring to FIG. 2, there may be seen rack 16. As represented in FIG. 2, the rack 16 would be made of synthetic material, however, it will be understood that it could be made of metal as shown as the rack 116 in FIG. 4 is represented. The rack includes flange 18 which fits flat against the wall 20 as seen in FIG. 3. The flange is connected by a plurality of fasteners 22 in the form of screws. The rack 16 includes lip 24 which extends upward and away from the wall 20. As may be seen in FIG. 2, the rack extends for substantially the entire length of the cornice frame. However, it may be understood that instead of one continuous rack 16, there could be sections of racks 16 and they could have spaces between them. I find it desirable to have the rack extend substantially the entire length, however, I have found if it extends for over one-half the entire length of the frame, satisfactory operations can be obtained. However, it is more difficult to level than if it extends for substantially the full length.

The frame has two basic sections called slides. The inner slide 26 telescopes within the outer slide 28. The inner slide includes end panel 30 which extends at right angles from the wall 20. The inner slide panel 30 has flap 32 which is fastened by screws 34 against the wall 20. The outer slide 28 also includes panel 36 which is parallel to the panel 30, also including a flap 32 which is attached by screws 34 to the wall.

The inner slide 26 has top 38 and the outer slide has top 40. Tongue 42 depends downward from the inner slide top 38 and tongue 44 extends downward from the outer slide top 40. As seen in FIG. 3, the tongues, both 42 and 44, extend against the wall and are between the wall 20 and the lip 24. Inasmuch as the rack 16, with its lip 24, extends for substantially the entire length as the frame, it may be seen that the frame is supported by its tongue 42 and 44 for substantially its entire length. In addition, the frame is supported at each end by the panel flap 32. Those skilled in the art may recognize that in extremely long spans, the front of the frame may sag downward. Those skilled in the art would understand that in such a case the center of the frame could be supported by L-bracket, much in the same fashion as the SUSNOW U.S. Pat. No. 2,570,731, uses for the sole support of his frame.

The inner slide 26 has front 46 which is parallel to the wall 20 and which is connected to the panel 30 and top 38. Also, the outer slide has front 48 which is likewise parallel to the wall connected to the top 40 and panel 36. The bottom of the front is turned under at 50 as seen in FIG. 3 for additional strength and rigidity. The inner slide telescopes within the outer slide, i.e., the inner slide top 38 is below the outer slide top 40 and the inner slide front 46 is behind the outer slide front 38. Also, the top of the inner slide top 38 and the bottom of the outer slide top 40 have correlative mating indentations or tongue and groove configurations 51 for strength and rigidity.

To install the embodiment as seen in FIGS. 2 and 3, first, the inner slide 26 and outer slide 28 are fitted together and telescoped so that they are the proper length, i.e., the distance from end panel 30 to end panel 36 is the desired distance. Then the two slides are stapled together. A scallop such as seen in FIG. 1 may be designed. A scallop design is then fabricated and stapled to the front 26 and 28 at flange 50. It may be seen that there will be a joint at the end of the outer slide 28, however, it will be understood that this will be very small and that when the front scallop is placed upon it, it will not be noticeable. If no scallop is placed upon it, foam rubber is placed over it to give a smooth appearance for the fabric. As seen in the drawing, foam rubber strip 52 is shown on the inside of the front 46 and 48. Also, foam rubber 52 is placed inside the panels 30 and 36. As pointed out before, the cornice must be finished on the inside as well as the outside because the inside is viewed through the windows 10 from outside the house.

After the cornice frame has been covered, rods 54 are placed upon supports 56 with the curtains thereon. The rack 16 is temporarily placed against the wall and one of the screws 22 is loosely attached at each end of the rack 16. Then the cornice frame with the drapes attached are lightly hung upon the rack 16 and the entire cornice with drapes are checked to see if they have the proper appearance. As stated, the ceiling may not be level, and the ceiling and floor may not be parallel, therefore, it is necessary to make certain that the drapes have the proper appearance rather than they be technically level or even. If one side or the other needs to be raised or lowered the screw 22 in that end is removed and either replaced in the proper position or in the event this is very near the original position, the screw can be inserted in the next closest hole in the rack 16. As soon as it is decided that the drapes and cornice have the proper appearance, the cornice frame is removed and the rack 16 is permanently attached to the wall by putting in the additional screws 22. Then the frame is again placed with the tongues 42 and 44 between the lip 24 and the wall 20 and the screws fasten the flaps 32 securely against the wall. This completes the hanging of the drapes and the cornice.

The frame for the valance, as illustrated in FIG. 4, is basically the same as the frame for cornices illustrated in FIG. 2. However as may be seen in FIG. 4 the rack 116 is shown here as made of metal. However, it likewise has flange 118 against the wall and is secured by fasteners 122. Lip 124 extends upward and spaced from the wall. The valance frame has inner slide 126 and an outer slide 128. The inner slide has top 138 and tongue 142 which fits between the lip 124 and the wall. The outer slide has top 140 with an outer tongue 144 which fits between the lip 124 and the wall. Also, as shown, there is the outer slide end panel 136 having an interior covering of foam rubber 152 with a flap 132 which is held against the wall by screw 134. For illustrative purposes, the valance frame of FIG. 4 is not shown with tongue and groove or indentations that correspond to the correlative indentations 51 of the embodiment shown in FIG. 2.

As an aid to correlating the terms of the claims to the exemplary drawing, the following catalog of elements is provided:

| | |
|---|---|
| 10 window | 36 outer end panel |
| 12 drapes | 38 inner slide top |
| 14 cornice | 40 outer slide top |
| 16 rack | 42 inner tongue |
| 18 flange | 44 outer tongue |

-continued

| | |
|---|---|
| 20 wall | 46 inner front |
| 22 fasteners | 48 outer front |
| 24 lip | 50 flange |
| 26 inner slide | 51 indentations |
| 28 outer slide | 52 foam rubber |
| 30 inner end panel | 54 rods |
| 32 flap | 56 rod holder |
| 34 screws | |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. An improved frame for valances and cornices placed against a wall comprising:

a. an inner slide having
   (i) an end panel with a flap flat against the wall and the panel extending from the wall,
   (ii) a top connected to the end panel with a depending tongue adjacent the wall for substantially the full length of the inner slide, b. an outer slide having
   (i) an end panel with a flap flat against the wall and the panel extending from the wall parallel to the inner slide end panel,
   (ii) a top connected to the outer slide end panel and telescoped over and stapled to the top of the inner slide with a depending tongue flat against the wall for substantially the full length of the outer slide, and c. a rack extending substantially from one end panel to the other end panel having
   (i) a flange flat against the wall,
   (ii) fasteners holding the flange to the wall, and
   (iii) an upwardly extending lip above the flange spaced from the wall, and d. said tongues positioned between the lip and the wall, with the inner slide tongue against the lip.

2. The invention as defined in claim 1 further comprising:

e. each of the slides having a front thereon attached to the end panel and top thereof and each front extending substantially the full length of the slide.

3. The invention as defined in claim 1 further comprising:

e. mating indentations on the top side of the top of the inner slide and on the bottom side of the top of the outer slide so as to maintain the elements in the desired relationship to one another.

4. The invention as defined in claim 1 further comprising:

e. said flaps fastened to the wall.

5. The invention as defined in claim 1 further comprising:

e. at least one rod holder on the inside of each end panel, f. at least one rod extending from one end panel to the other supported by said rod holders.

6. The invention as defined in claim 1 further comprising:

e. said inner and outer slides made of a composition material.

7. The invention as defined in claim 6 further comprising:

g. said flaps fastened to the wall.

8. The invention as defined in claim 7 further comprising:

h. at least one rod holder on the inside of each end panel, j. at least one rod extending from one end panel to the other supported by said rod holders.

9. The invention as defined in claim 8 further comprising:

k. mating indentations on the top side of the top of the inner slide and on the bottom side of the top of the outer slide so as to maintain the elements in the desired relationship to one another.

10. The invention as defined in claim 9 further comprising:

m. each of the slides having a front thereon attached to the end panel and top thereof and each front extending substantially the full length of the slide.

11. The method of installing frames for cornices and valances comprising the steps of:

a. temporarily attaching a rack to the wall by a few fasteners, said rack extending over half the length of the frame, b. hanging the frame and associated curtains from the rack with the frame contacting the wall for over half its entire length, c. checking the hung material for appearance, d. removing the hung material from the rack, e. permanently attaching the rack to the wall by additional fasteners, and f. hanging the frame to the permanently attached rack, with the frame contacting the wall for over half its entire length, g. thus, supporting the frame for over half its contact to the wall.

12. The invention as defined in claim 11 further comprising:

h. telescoping two slides together to form said frame, and j. adjusting the length of the frame and fixing it to adjusted length before hanging the frame upon the rack.

* * * * *